US005615425A

United States Patent [19]

Corente

[11] Patent Number: 5,615,425

[45] Date of Patent: Apr. 1, 1997

[54] FITTED SHEET FOR USE AS A DISPOSABLE STRETCHER/GURNEY LINEN

[76] Inventor: Joseph N. Corente, 2606 Whale Harbor La., Fort Lauderdale, Fla. 33312

[21] Appl. No.: 540,004

[22] Filed: Oct. 6, 1995

[51] Int. Cl.[6] ..... A61G 1/01; A47G 9/00

[52] U.S. Cl. ..... 5/81.1 T; 5/495; 5/497; 5/625; 297/229

[58] Field of Search ..... 5/81.1 T, 497, 5/482, 490, 487, 485, 501, 495, 496, 499, 498, 620, 625, 627; 297/229, 188.01

[56] References Cited

U.S. PATENT DOCUMENTS

| | | | |
|---|---|---|---|
| 1,959,920 | 5/1934 | Kaiser | 5/498 |
| 2,695,415 | 11/1954 | Ford et al. | 5/497 |
| 3,258,789 | 7/1966 | Banks | 5/485 |
| 3,654,646 | 4/1972 | McMahon, Jr. | 5/485 |
| 3,824,640 | 7/1974 | Golden | 5/485 |
| 4,461,048 | 7/1984 | Allaire, Jr. | 5/497 |
| 4,553,785 | 11/1985 | Duke, Jr. et al. | 297/229 |
| 4,877,288 | 10/1989 | Lee | 297/229 |
| 4,892,353 | 1/1990 | Goddard | 297/229 |
| 5,189,744 | 3/1993 | Roberts | 5/497 |

FOREIGN PATENT DOCUMENTS

| | | | |
|---|---|---|---|
| 634125 | 1/1995 | European Pat. Off. | 297/229 |

*Primary Examiner*—Alexander Grosz
*Attorney, Agent, or Firm*—McAulay Fisher Nissen Goldberg & Kiel, LLP

[57] ABSTRACT

A fitted sheet for use as a disposable stretcher/gurney linen, comprising an elongated sheet having a length and a width adapted to accommodate and be placed onto a stretcher/gurney to cover a mattress carried by the stretcher/gurney and prevent the mattress from being soiled, the length dimension being greater than the width dimension, at least one end of the length dimension is protected for temporary connection with the mattress for retaining the sheet on the mattress when the sheet is placed onto the mattress, and a flap on each side of the sheet extends along the length dimension for use as carriers to lift the sheet and move it with an individual thereon from one place to another.

11 Claims, 3 Drawing Sheets

FITTED SHEET FOR USE AS A DISPOSABLE STRETCHER/GURNEY LINEN

BACKGROUND OF THE INVENTION

This invention relates to linens for use in emergency transport in connection with medical and hospital usage. More particularly, the invention is concerned with linens or sheets for use on a stretcher or a hospital gurney.

The invention is also concerned with an individual linen temporary transporter to be used with a stretcher or other mechanism to transport an individual from or to a stretcher or a hospital gurney and prevent the mattress from being soiled.

The invention is also usable in hospitals and elsewhere to move an individual such as a patient from a hospital gurney or EMS stretcher to a hospital bed.

DESCRIPTION OF THE PRIOR ART

Heretofore, bed sheets, regardless of the material from which they are manufactured, have been sized so that they can be used on a bed in a hospital facility. This creates many problems with respect to the usage of these linens on gurneys and stretchers.

For example, if a particular type of linen is used in connection with a stretcher, there may be extraneous and excess portions which extend beyond the edges of the stretcher, which are necessary to tuck in the sides along the long or width sides or along the narrow or head and feet portions.

SUMMARY OF THE INVENTION

It is therefore an object of the invention to provide a sheet or linen for use in connection with a stretcher and/or gurney used to transport an invalid or an injured individual from an outside area of the hospital to the hospital or from one part of the hospital to another part of the hospital.

Another object of the invention is to provide for a sheet fitted to the ambulance/paramedic stretcher pad and the hospital emergency room stretcher/gurney pad.

For this purpose, the present invention proposes to provide for a sheet having a substantially oblong dimension in which the length is substantially longer than the width. Since a mattress for use with an EMS stretcher or a hospital stretcher or gurney is generally of a width of about 24 and 30 inches, respectively, and a length of about 72 and 76 inches, respectively, a sheet for the stretcher is desirably provided with a pocket at each of the long extremities extending across the narrow width extending transversely to the longitudinal (long) axis of the sheet and a carry portion extending from each of the sides of the short extremities, connecting the long extremities. Each pocket includes a first portion which is folded over and stitched along each edge to the undersides of the sheet so that the short width of the head end of the mattress can fit into one pocket and the short end width of the foot portion can fit into another portion or pocket. The two sides, which extend between the pockets and extend from the width portion of the sheet, are preferably made with a dimension larger than the width of 24 and 30 inches, respectively, for these stretchers, and these additional side portions can be used by two or more individuals (one on each side of the width portion) to transport an injured person from a stretcher to a stretcher or a stretcher to a bed.

Another feature of the invention is that the sheet according to the invention is strong enough to use as a "DRAW SHEET". The term "DRAW SHEET" is used by emergency clinicians to denote a sheet strong enough to move a patient from one stretcher to another or from a stretcher to a hospital bed.

A poly film is added to the material from which the sheet is made to provide a fluid barrier. This barrier keeps body fluids (blood, urine etc.) from passing through the sheet onto the stretcher or gurney and provides additional strength to the sheet. The sheet is preferably 0.75 mil thick and is made of polyethelene or polypropylene.

A chemical treatment has also been added to the material to provide an absorbent capability. Clinicians do not want the blood or other body fluids to slide off the sheet onto them or the floor. This hydrophilic chemical soaks up these body fluids and retains them on the sheet.

Other objects, advantages and the nature of the invention will become readily apparent from an explanation of the invention taken in connection with the accompanying drawings.

DESCRIPTION OF THE PREFERRED EMBODIMENT

Figure 1:
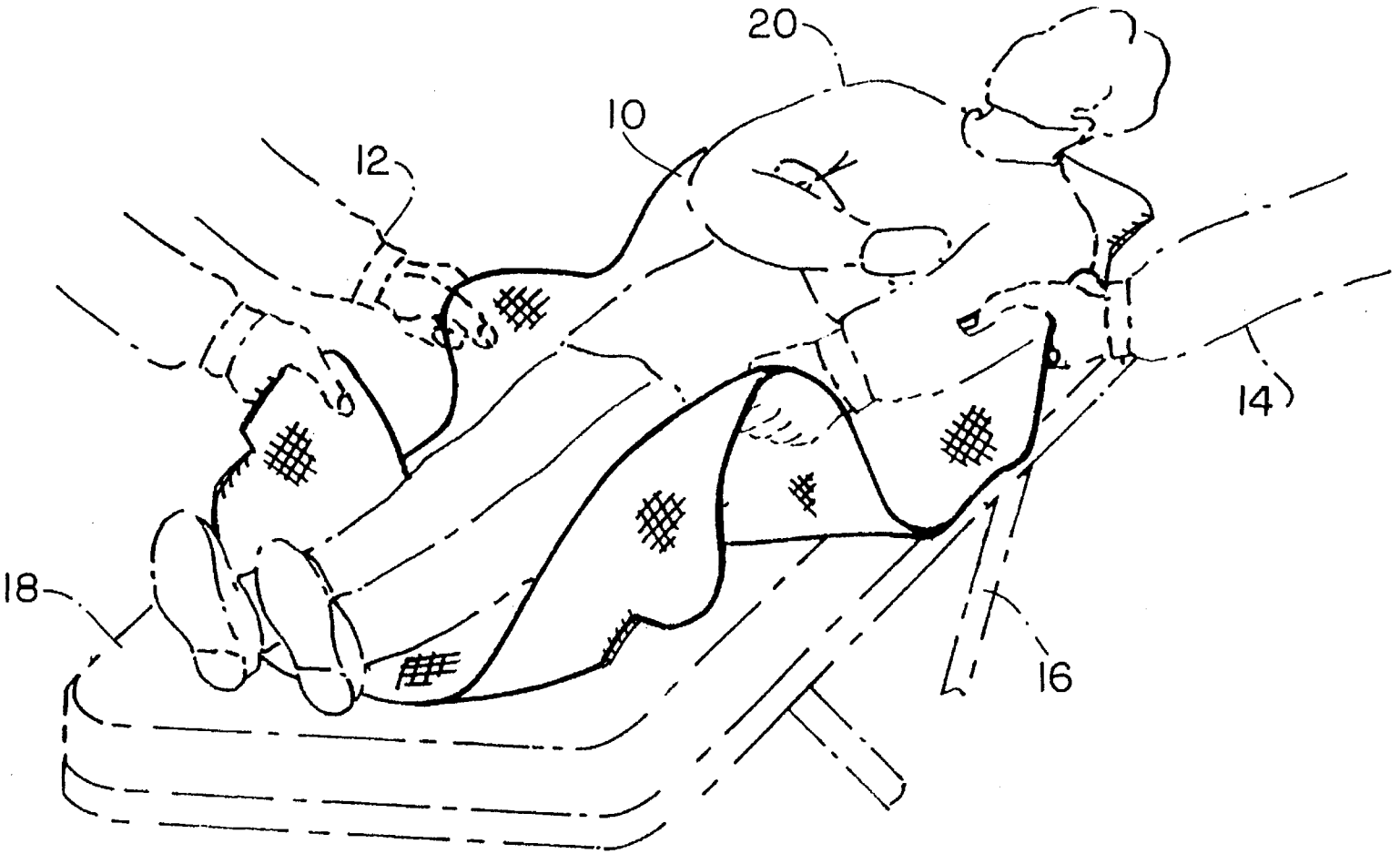
FIG. 1 is a perspective view of an individual transporter mattress fitted sheet and a transporter vehicle for use in transporting an individual who may be disabled or sick from one area to another, illustrating an individual in phantom outline on the individual transporter mattress fitted sheet and portions of other individuals, in particular their hands or arms, also shown in phantom, carrying the individual transporter mattress fitted sheet.

Referring now to the drawings and more particularly to FIG. 1 which shows the presently preferred mode for carrying out the invention, an individual transporter mattress fitted sheet 10 is shown with a schematic showing of hands 12 of one individual on one side of the individual transporter and hands 14 of another individual on the other side substantially subsequent to the placement of the individual transporter onto transporter vehicle 16, schematically shown in dashed outline, provided with a conventional mattress 18. Transporter 10 could be completely fitted while an individual 20 is being transported. The individual transporter 10 is also usable to remove the individual 20 from the transporter vehicle.

Figure 2:
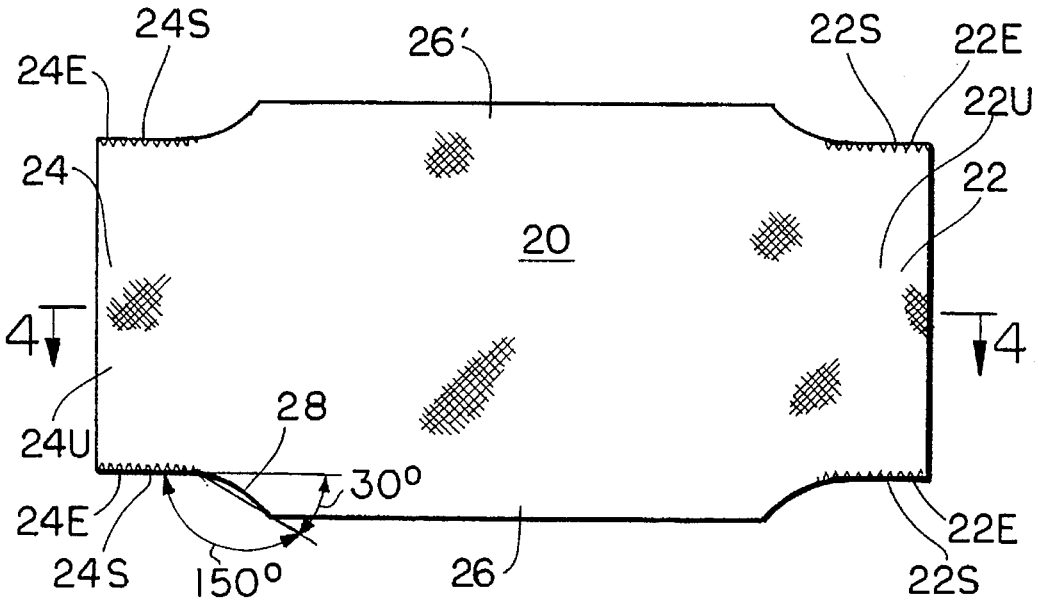
FIG. 2 is a front view of the individual transporter mattress fitted sheet for use with the transporter vehicle, showing one modification of the invention.
Figure 4:
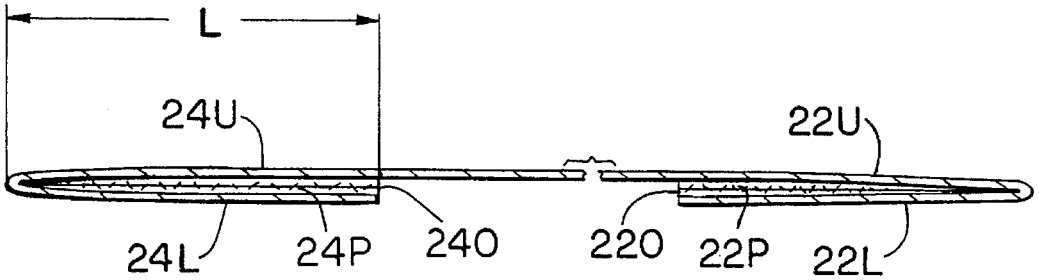
FIG. 4 is a sectional view taken along line 4—4 of FIG. 2, and the sectional view of the FIG. 3 embodiment is the same as that of the FIG. 2 embodiment.

Referring now more particularly to FIGS. 2 and 4, which show one embodiment of the individual transporter comprised of a center portion 20 with a pair of longitudinal end parts 22 and 24, and width side parts 26, 26' which form carders or handle-type members. Each end part 22, 24 includes an upper portion 22U, 24U and a lower portion 22L, 24L to form the upper and lower portions, respectively, of pocket 22P, 24P at each end. The edges 22E of the upper and lower parts 22L and 22U are seamed together at 22S to leave an opening 22O for entry of the end portions into the pocket 22P.

Upper portions 22U, 24U are coextensive with and coplanar with center portion 20, and the lower portions 22L, 24L are folded under the upper portions 22U, 24U.

In a similar manner, edges 24E of upper part 24U and lower part 24L are seamed together at 24S to leave an opening 24O for entry into pocket 24P.

It is within the scope of the invention to provide the individual transporter 10 with only one pocket at each end, such as 22P or 24P. However, an individual pocket 22P and 24P at each end is a preferred embodiment of the invention. If the transporter is to be used for emergency purposes and the production of a completely fitted sheet for the mattress is not of paramount importance, then either one or no pocket need be provided.

Connected with each side of center portion 20 along the width side parts are flaps or carriers 26 and 26'. The width of one preferred form of sheet between the edges 22E is approximately or substantially twenty-eight (28") inches or more or about seventy six centimeters and the flaps are about two (2") inches or more on each side for EMS stretchers and thirty-four (34") inches or more minimum for hospital stretcher to permit an individual such as individuals represented by their hands 12 and 14 (schematically shown in FIG. 1) to be able to hold onto the individual transporter 10.

Portion 28 extending between flaps or carriers 26, 26" and pockets 22E and 24E are arcuate and are shown with an included angle of about 150° so that the angle between an extension of the outer edge 24E and arcuate side 28 is about 30°.

The pockets 22P, 24P extend across the width of the center portion 20 transverse to the longitudinal axis thereof. Extending along the longitudinal axes are the pair of flaps 26, 26', which are used to lift an individual by means of the individual transporter.

Figure 3:
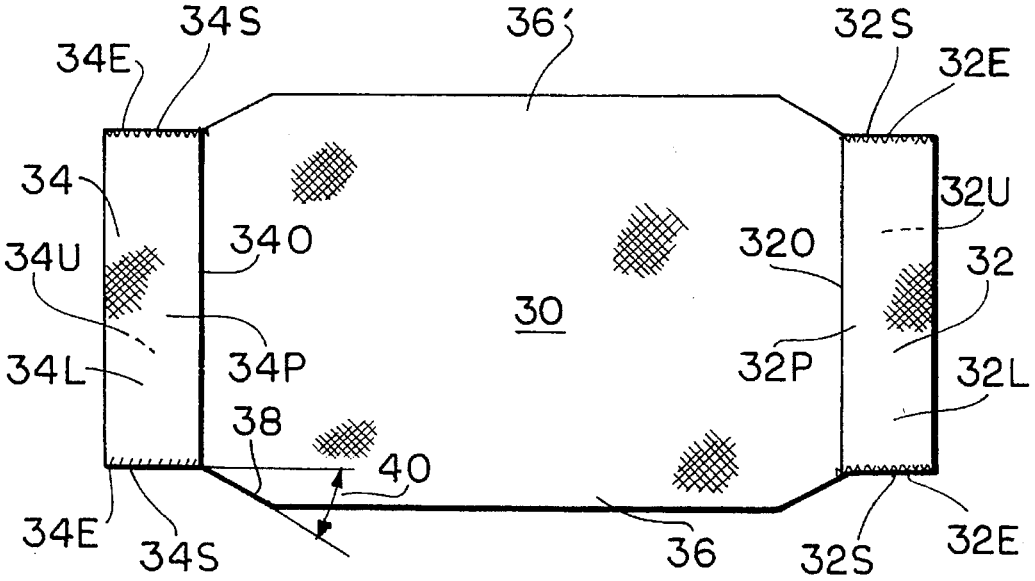
FIG. 3 is a rear view of the type of individual transporter mattress fitted sheet of FIG. 2, but showing a modification of the FIG. 2 embodiment.

Referring now to FIG. 3, the same or similar parts are designated with the reference numerals in the 30's. In this embodiment, connector joining portion 38 is straight to provide for a more rapid ease of manufacture and the angle 40 can vary between about 30° and 40°. The difference between the FIG. 2 and FIG. 3 embodiments is the manner of extension of the flaps 26, 26' and 36, 36'.

The showing in FIG. 4 is the some whether the FIG. 2 or FIG. 3 embodiment is used.

Figure 5:
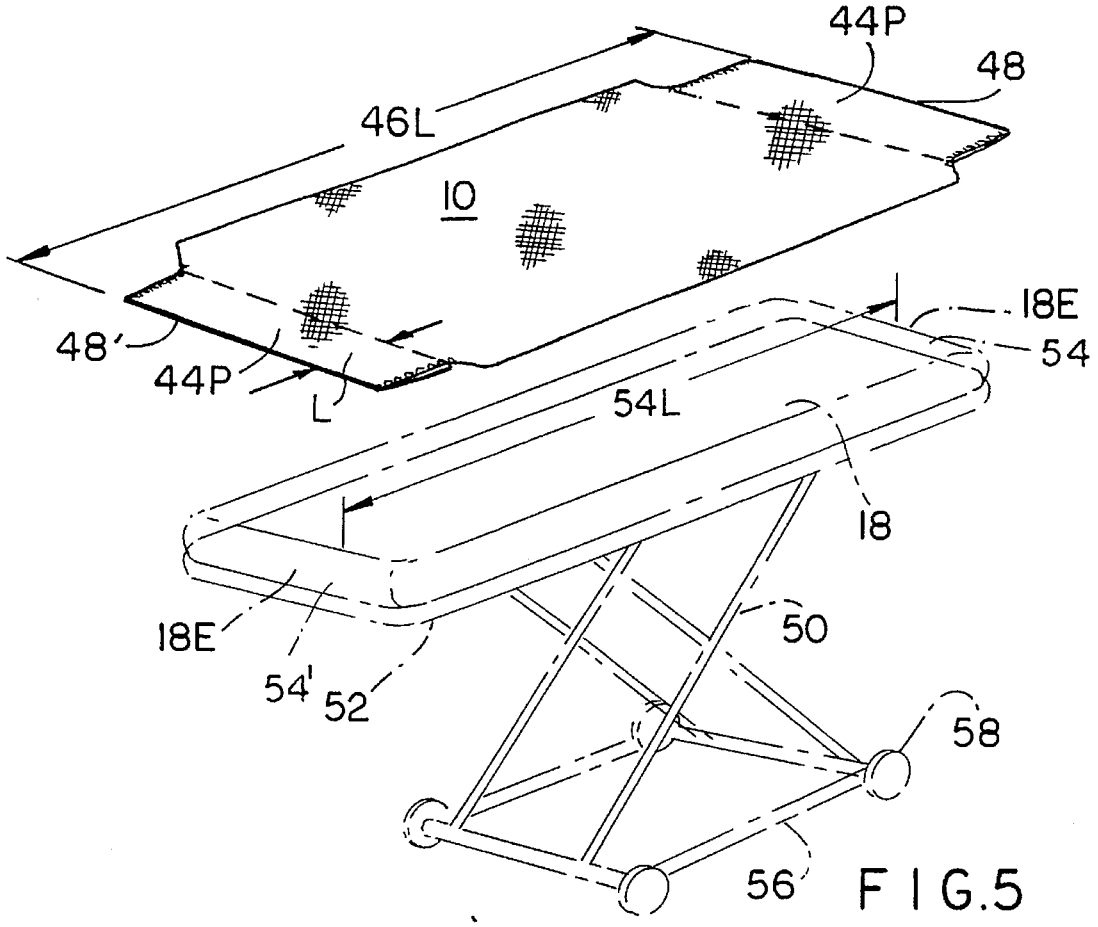
FIG. 5 is a perspective view of a transporter vehicle shown in phantom outline with the individual transporter mattress fitted sheet shown in FIG. 1 positioned above the vehicle transporter.
Figure 6:
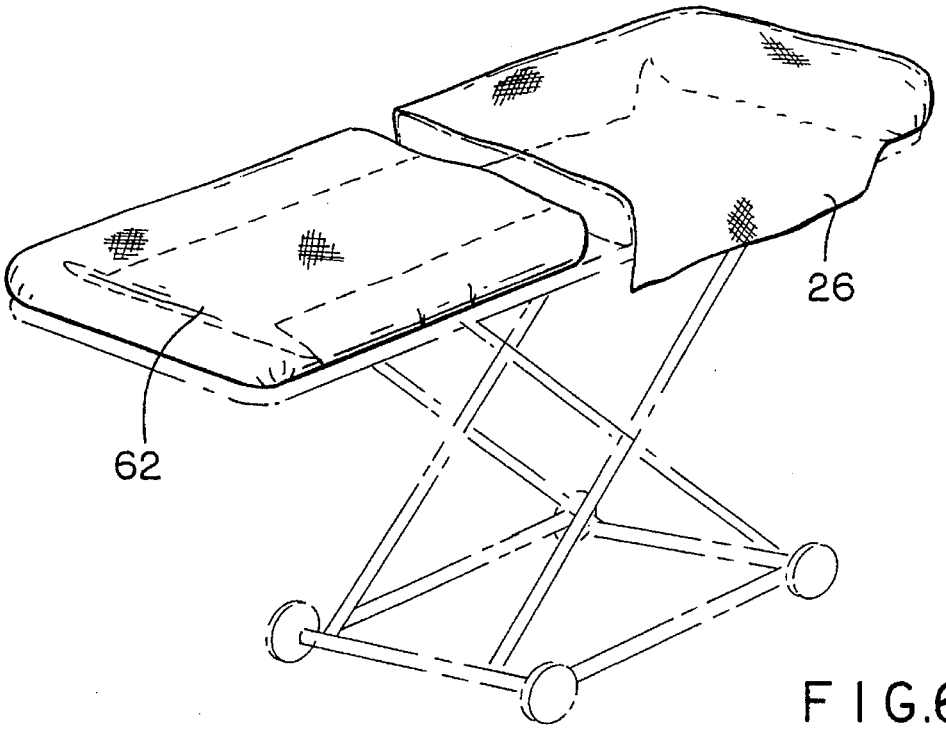
FIG. 6 is a perspective view of sheet somewhat similar to the sheet shown in FIG. 4, with the individual transporter mattress fitted sheet separated into two parts. The part towards the left side of the drawing shows the individual transporter mattress and fitted sheet completely assembled and on the transporter vehicle, and towards the right side of the drawing, the individual transporter mattress and the fitted sheet are shown in an intermediate stage subsequent to the placement onto the vehicle transporter, but prior to the complete assembly as shown on the left side.

Referring now more particularly to FIGS. 5 and 6, a conventional type of invalid stretcher transporter or vehicle transporter 50 is shown with a conventional mattress 18 thereon. The conventional invalid stretcher transporter or vehicle transporter 50 includes a top platform 52 onto which the conventional mattress 18 is placed. The scissor type legs provided with support on base 56 provided with wheels 58 are collapsible to fit with an ambulance type of conveyor, as well as to provide for reduced storage space requirements.

Individual transporter 10, which may be of the type either shown in FIG. 2 or FIG. 3, is moved from its FIG. 5 position and placed onto the mattress 18 as shown in FIG. 6 and the pockets 42P, 44P, shown generically, extend over the opposite edges 18E along the width of the mattress. Because the longitudinal distance 46L between the opposite ends of the pockets 48, 48' are made to conform and equal the longitudinal extent or distance 54L between edges or ends 54, 54' the individual transporter 10 achieves a smooth and substantially wrinkle free top 62 as shown in FIG. 6 after the flaps or carrying portions 26, 26' are tucked beneath the mattress and between the bottom of the mattress 18. In FIG. 6, the individual transporter 10 has the flaps 26, 26' shown tucked under the mattress in one portion. At the left side of the driving the flaps 26, 26' are tucked under the mattress, and at the right side of the drawing the flaps or carrying portions 26, 26' are shown in their position prior to being tucked under the mattress.

The material used to construct the individual transporter 10 is generally termed "linen" although it may not be made from the material, which is yarn, thread or cloth made from flax. Linen is the general term used for the material to cover a mattress.

The flaps or carriers 26, 26' desirably can vary in width from between two inches and five inches, while three inches is the preferred extent to reduce costs. Three to five inches will provide the appropriate amount of material to facilitate the carrying of an individual depending on whether the sheet is for hospital or ambulance usage.

The length L of the portions 22L, 24L, 32L, 34L, folded under to form the pockets, is preferably six inches to provide a sufficient extent to extend over the opposite edges 18E of the mattress 18.

Angle 40 can vary between 30° and 40°, and 35° is preferred and has been found to provide ease of placement onto the mattress.

The partially arcuate portion 28 of the FIG. 2 embodiment is preferred because it provides for ease of use, folding of the carry portions or flaps under the mattress, and the holding power of the sheet to support an individual.

The edges are seamed together to form two sides of the pockets to provide for proper connections and to avoid separation.

The seams can be extended along 38 for greater rigidity and strength. While, there has been shown what are considered to be the preferred embodiments, various changes and modifications may be made without departing from the scope of the invention.

What is claimed is:

1. A fitted stretcher sheet for use as a disposable stretcher/gurney linen, comprising:

an elongated sheet having a length and a width adapted to accommodate and be placed onto a stretcher/gurney to cover a mattress carried by the stretcher/gurney and prevent the mattress from being soiled, said sheet having a length dimension and a width dimension with said length dimension being greater than said width dimension;

first retention means including a pocket with an opening at, at least one end of said length dimension for temporary connection with one end of the mattress and second retention means for retaining said sheet on said mattress when said sheet is placed onto said mattress;

a narrow flap positioned along only a center portion on each side of said sheet along its length dimension between said first and said second retention means with one end of each flap positioned proximate to said opening, and the other ends of each said flaps being positioned proximate to said second retention means, said flaps extending along said length dimension for use as carriers for said sheet to lift said sheet with the individual thereon and move it with the individual thereon from one place to another, and the width of said flaps being about two inches or more.

2. The fitted stretcher sheet as claimed in claim 1, wherein the width of said flap is between 3 to 5 inches.

3. The fitted stretcher sheet as claimed in claim 1, wherein said sheet has an oblong dimension with a width that varies between 24 and 30 inches and a length that varies between 72 and 76 inches.

4. The fitted stretcher claimed in claim 1, wherein said second retention means includes a pocket extending transversely to a longitudinal axis of the sheet for receiving an end of the mattress opposite to said one end.

5. The fitted stretcher sheet as claimed in claim 4, wherein each of said pockets include a longitudinal end part having a lower portion and an upper portion co-extensive with a center portion of said sheet, said lower portion being folded under its respective upper portion, and seams to seam sides of said upper portion to its respective lower portion to leave the opening to receive the end of the mattress.

6. The fitted stretcher sheet as claimed in claim 5, wherein said pockets extend across a width dimension extending transversely to said length dimensions.

7. The fitted stretcher sheet as claimed in claim 1, wherein said pocket includes a longitudinal end part having a lower portion and an upper portion co-extensive with a center portion of said sheet, said lower portion being folded under its respective upper portion, and seams to seam sides of said upper portion to its respective lower portion to leave an opening to receive an end of the mattress.

8. The fitted stretcher as claimed in claim 7, including arcuate portions joining said flaps with said seams.

9. The fitted stretcher sheet as claimed in claim 8, wherein an outer edge of said flap and an extension of a side of width edge of said pocket has an angular spacing of about 30° to 40°.

10. The fitted stretcher sheet as claimed in claim 1, wherein said flaps have a width sufficient for them to be tucked in under the mattress.

11. The fitted stretched sheet claimed in claim 1, wherein the sheet has a thickness of 0.75 mil.

* * * * *